United States Patent [19]

Gustafson

[11] 4,344,195

[45] Aug. 17, 1982

[54] BED HAVING TWO MUTUALLY DISPLACEABLE FRAMES FOR WALL SIDE ACCESS

[76] Inventor: Hans H. Gustafson, Trädgårdsgatan 22, S-172 38 Sundbyberg, Sweden

[21] Appl. No.: 186,022

[22] PCT Filed: Mar. 1, 1979

[86] PCT No.: PCT/SE79/00044

§ 371 Date: Nov. 2, 1979

§ 102(e) Date: Sep. 4, 1979

[87] PCT Pub. No.: WO79/00689

PCT Pub. Date: Sep. 20, 1979

[30] Foreign Application Priority Data

Mar. 2, 1978 [SE] Sweden ..... 7802353

[51] Int. Cl.[3] ..... A47C 19/04

[52] U.S. Cl. ..... 5/11; 5/8; 5/63

[58] Field of Search ..... 5/11, 8, 9 R, 9 B, 63, 5/65, 21

[56] References Cited

U.S. PATENT DOCUMENTS

| | | | |
|---|---|---|---|
| 2,628,369 | 2/1953 | Urban | 5/22 |
| 3,693,199 | 9/1972 | Wintmerthur | 5/9 |
| 3,887,950 | 6/1975 | Wachsman | 5/11 |
| 3,987,503 | 10/1976 | Kean | 5/11 |

*Primary Examiner*—Alexander Grosz

*Attorney, Agent, or Firm*—Sughrue, Mion, Zinn, Macpeak and Seas

[57] ABSTRACT

A bed has a first frame structure (2,5,11,12) and a further frame structure (6). The first frame structure has a support surface (2) for a mattress or the like, and between the two frame structures is arranged at least one pivot-arm mechanism (14) for lifting the first frame structure up from the further frame structure and to cause, at the same time, lateral displacement in the width direction of the rectangular support surface and preferably also in its longitudinal direction. In the normal positions of the frame structure, the further frame structure has at least one longitudinally extending side part (24) located inwardly of the nearest side edge (4) of the support surface, and during said lateral displacement said side edge is moved towards and over said side part.

5 Claims, 5 Drawing Figures

BED HAVING TWO MUTUALLY DISPLACEABLE FRAMES FOR WALL SIDE ACCESS

Figure 1:
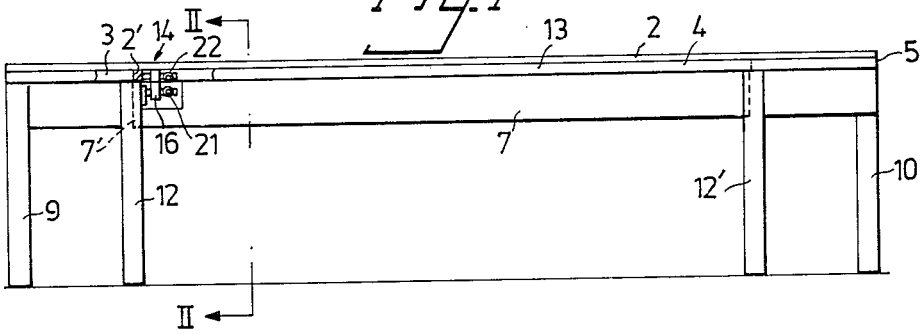

The present invention relates to an arrangement in beds comprising a first frame structure having a rectangular support surface whose length is greater than its width; a further frame structure arranged to be supported on a foundation; and at least one pivot-arm mechanism which is arranged between said frame structures and connected to pivot locations mounted thereon, said mechanism being arranged to pivot between a first, downwardly swung position and a second upwardly swung position and, as a result of said pivot movements, to alter the vertical distance between the two frame structures and, at the same time, to displace the first frame structure laterally relative to the said further frame structure.

Arrangements of this type, which are mainly intended to raise the bed, are well known and an example of such is described, for example in U.S. Pat. No. 3,887,950. Even though an arrangement of this kind can be constructed so that the bed will be raised to a level which allows the bed to be made without it being necessary to stoop it does not improve the accessibility to the bed and its surroundings. This is due to the fact that normally beds are placed so that one long side and/or one end thereof extends along a wall and that the lower frame structure, which is stationary even when the bed is displaced laterally, prevents free passage around the bed.

Consequently it is a primary object of the invention to provide an arrangement of the kind mentioned in the introduction which will permit free passage around the bed when said bed is lifted, to allow it to be made at an optimum working height, even when the bed, in its normal position between the two frame structures, has a longitudinally extending edge and/or a short end edge contiguous to one wall.

This primary object is realized in accordance with the invention mainly by the fact that the said further frame structure in the downwardly swung position of the pivot-arm mechanism has at least one longitudinally extending side part located inwardly of the nearest longitudinally extending side edge of the support surface; that the pivot-arm mechanism is arranged, when swung upwardly, to lift the first frame structure and displace it laterally at least in the width direction of said support surface and to move said longitudinally extending side edge of said support surface towards and over the said longitudinally extending side part of said further frame structure.

Due to the fact that the longitudinally extending side part of the further frame structure lies inwardly of the nearest side edge of the support surface in the normal position of the bed, i.e. when the pivot-arm mechanism or pivot-arm mechanisms are collapsed, said side part will not project outwardly to prevent the bed from being fully pushed against a wall. When the bed is lifted, the first frame structure, and therewith said side edge of the support surface, will move away from the wall and in towards and over said side part, thereby to form between the wall and the bed a space which permits passage between said wall and said bed, whereby making of said bed is facilitated.

In a preferred embodiment of the invention, the arms of the pivot-arm mechanism are pivotable in a vertical plane which is inclined relative to the longitudinally extending edges of the bed, thereby enabling the bed to be laterally displaced both in the width direction of the bed and its longitudinal direction. In addition to the free space along one long side of the bed, there is also provided in this way a free space along one end of the bed, provided that an end part of the further frame structure lies inwardly of a corresponding short end of the support surface in the normal position of the bed.

Figure 2:
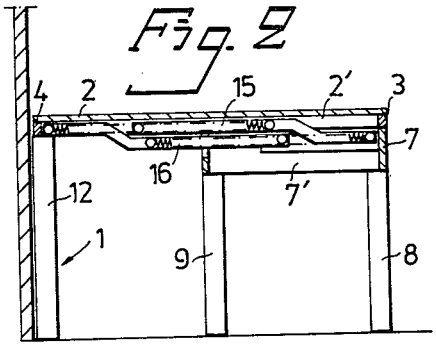
Figure 3:
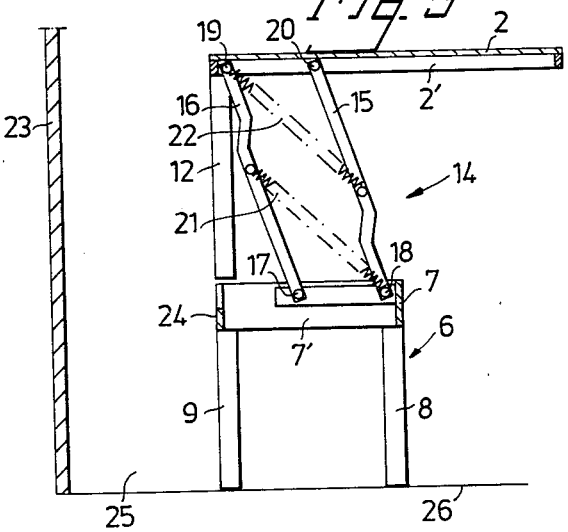
Figure 4:
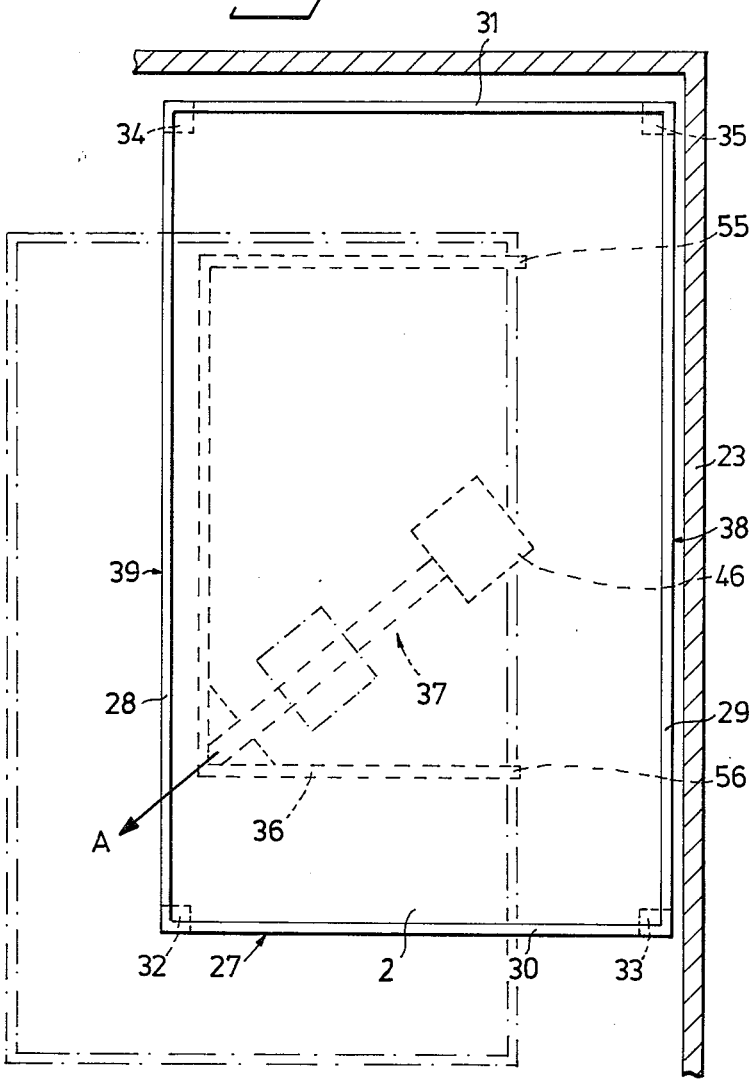
Figure 5:
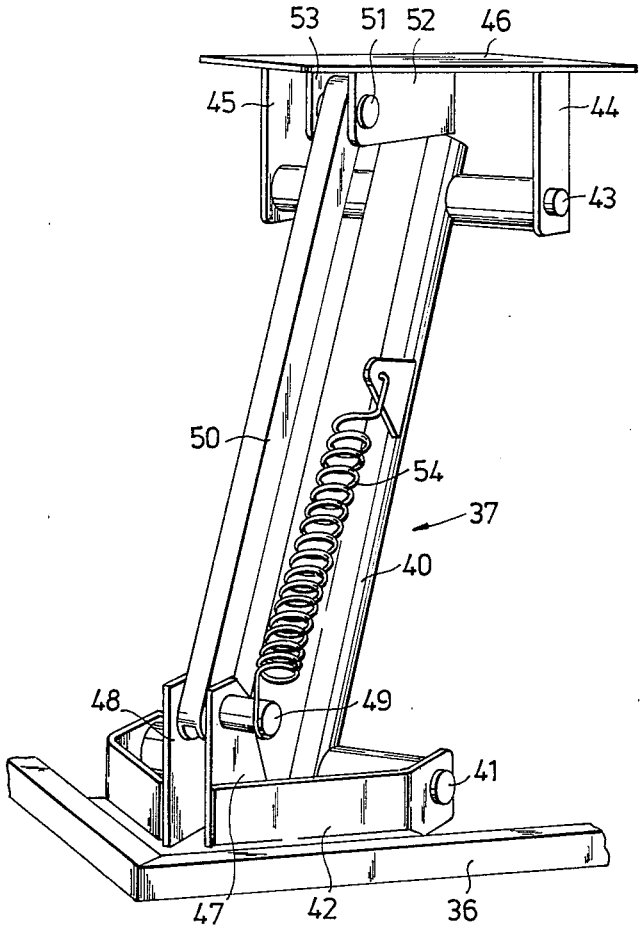

So that the invention will be more readily understood and optional features thereof made apparent, exemplary embodiments of the invention will now be described with reference to the accompanying schematic drawings, in which FIG. 1 is a cut-away side view of a bed according to a first embodiment, FIG. 2 illustrates the bed shown in FIG. 1 seen along the lines II—II in FIG. 1 and in a collapsed position with one longitudinal extending edge of the bedbeing located along a wall, FIG. 3 is a view from one end of the bed according to FIG. 1, the support surface having been raised to the position in which the bed is made, FIG. 4 is a plan view of a bed having a further embodiment of the invention, and FIG. 5 is a perspective view of the pivot-arm mechanism shown in FIG. 4 and illustrates a part of the further frame structure.

The embodiment illustrated in FIGS. 1–3 comprises a first frame structure 1 on which there is arranged a sheet of material forming a support surface 2 for a mattress or the like (not shown). As will be seen when comparing FIGS. 1 and 2, the support surface is of an oblong configuration, having two mutuallly parallel long sides 3 and 4 and two short sides, such as the short side 5 in FIG. 1. Also shown in the figures is a further, second frame structure 6 comprising an oblong frame 7 which has a smaller width and length than the support surface 2. The frame 7 is provided at both short ends thereof with legs 8,9,10. The frame structure 1 is provided along the long side 4 thereof with two support legs 12 and 12' respectively, said legs being arranged inwardly of the short sides of the support surface 2.

Between the first frame structure 1, which in the illustrated embodiment includes legs 12 and 12' and a frame 13 which extends around the support surface 2, and the further frame structure 6 are mounted two pivot-arm mechanisms, of which only one mechanism, 14, is illustrated in the figures. The two pivot-arm mechanisms are connected to an intermediate member 7' of the frame 7 and to a cross stay 2' of the support surface 2. Each of the pivot-arm mechanisms is of a conventional type, and includes two pivot arms 15,16, whose lower endsare connected to pivot locations 17 and 18 respectively, and whose upper ends are connected to respective pivot locations 19 and 20.

The distance between the pivot locations 17 and 18 is equal to the distance between the pivot locations 19 and 20. Springs 21,22 are arranged between the pivot arms 15,16 in a known manner, in order to balance the mass of the first frame structure 1 as it is swung. As will be seen from FIGS. 2 and 3, one long side of the bed is placed against a wall 23. Further in accordance with the invention, the long edge 4 of the frame structure 1 facing the wall 23 is located externally of the adjacent edge part 24 of the further frame structure. The distance between the edge 4 and the edge part 24 can vary and, in the illustrated embodiment of FIGS., 1–3, is approximately half the width of the support surface 2. When the frame structure 1 is lifted upwardly and the pivot-arm mechanism 14 is swung to the position illustrated in FIG. 3, the support surface 2 has reached the intended height at which the bed can be made without it being necessary to stoop to an uncomfortable position, and, moreover, the first frame structure 1 has been moved in the direction of the width of the bed through a distance such as to form a free space 25 between the wall 23 and the frame 6 which rests on the foundation or floor 26. The width of the free space naturally depends upon the extent to which the frame structure 1, with the support surface 2, is displaced in the width direction of the bed, but should be at least 30 cm in order for free passage to be had by the person making the bed.

FIGS. 4 and 5 are simplified views of a further embodiment of the invention, which is particularly suited for the conversion of existing beds. Arranged in a frame 27 is a sheet of material forming a support surface 2, as in the first embodiment, on which a mattress or the like can be placed. The frame 27, which is of oblong configuration and which has two long-sides 28 and 29 respectively and two short-sides 30 and 31 respectively, is provided at the four corners thereof with four legs 32, 33, 34 and 35, which in the normal position of the bed rest against a foundation. The frame 27 together with legs 32–35 and the sheet 40 form a first frame structure. A further frame structure 36 is formed, in the illustrated embodiment, by a U-shaped steel frame 36 which rests against the foundation or floor and which is relatively low, for example, extends from 5–20 mm above the foundation or floor. It is possible to form the said further frame structure 36 from a relatively thin sheet of wood, metal or plastics material, or as a grid structure. The singular purpose of the frame structure 36 is to support the first frame structure when it is raised by means of the pivot-arm mechanism 37, and consequently must have support locations which are spaced a sufficient distance apart to prevent the bed from toppling or tilting.

The pivot-arm mechanism, shown in detail in FIG. 5, is fixedly mounted to one corner of the frame structure 36 and extends obliquely relative to the two mutually parallel long edges 38,39 of the support surface. The mechanism comprises a first tubular pivot arm 40, whose lower end is pivotally mounted on a shaft 41 which in turn is mounted on a stirrup-like structure 42 connected to the frame structure 36. The upper end of the arm is pivotally mounted on a shaft 43 which is journalled in two bearing elements 44,45, which extend downwardly from a fixed plate 46, which is connected to the support surface 2. The stirrup-like structure 42 has two upstanding bearing elements 47,48 for a shaft 49 on which the lower end of an arm 50 is pivotally mounted, said arm 50 being parallel with the arm 40. The upper end of the arm 50 is pivotally mounted on a shaft 51 which is journalled on the bearing elements 52,53, which are fixedly mounted on the attachment plate 46. Arranged between the shaft 49 and the arm 40 is a tension spring 54, said spring being arranged to balance the pivot-arm mechanism in a known manner.

The end part of the further frame structure facing the wall 23, which end part is defined in the illustrated embodiment by the end locations 55,56 on the frame structure 36, lies inwardly of the nearest lying edge part 38 of the first frame structure when the pivot-arm mechanism 37 is in its downwardly swung position. When the pivot-arm mechanism 37 is swung upwardly, by lifting the frame 27, and thereby taking the position illustrated in FIG. 5, the first frame structure 27,42,32,33,34,35 will be lifted from the further frame structure 36 and, at the same time, the said first frame structure is displaced in the direction of arrow A (FIG. 4). i.e. at right angles to the pivot shafts 41,43,49,51, said pivot shafts being parallel with each other and with the horizontal plane of the support surface 2. In the raised position of the first frame structure, the support surface 2 will therefore take the position illustrated in chain lines in FIG. 4. Consequently, the free space is obtained between the short side 31 and the wall 23 and between the long-side 29 and said wall 23. This space allows free passage for the bed to be made.

The invention is not restricted to the two, illustrated embodiments thereof, but can be modified within the scope of the accompanying claims. Thus, for example, the legs 12 and 12' on the first frame structure shown in FIGS. 1–3 can be omitted and the further frame structure 6 made so wide that the bed will be stable under all circumstances. The illustrated and described, conventional pivot-arm mechanisms can be replaced by other known pivot-arm mechanisms, and locking means can be provided for locking the mechanisms in their upwardly and/or downwardly swung positions. In the aforegoing the support surface of the first frame structure has been described as a sheet of material, although it may also comprise, of course, a frame having springs or strips of elastic, or some other known form of bed bottom.

Further, the embodiment shown in FIGS. 4 and 5 can be modified by replacing the frame structure 36 with a fixed plate, screwed to the foundation or floor.

I claim:

1. A bed having a first, upper frame structure (5, 12,12'; 27,28, 32,33,34,35) including a rectangular mattress or bedding support surface (2) whose length is greater than its width; a second, lower frame structure (6; 36) adapted to be mounted on a floor (26); and at least one pivot-arm mechanism (14; 37) disposed between said first and second frame structures and connected to pivot locations (17–20; 41,43,49,51) mounted on respective ones of said frame structures, said pivot-arm mechanism being swingable between a first, downward position and a second, upward position, said pivot-arm mechanism altering, during said swinging movements, the vertical distance between the two frame structures and simultaneously displacing the first frame structure laterally relative to the second frame structure, characterized by: the rectangular support surface having an outer contour exceeding that of said second frame support, the outer contour of said second frame structure in the downward position of the first frame structure lying within the outer contour of the first frame structure, the pivot-arm mechanism being configured to lift and laterally displace the first frame structure, when swung upwardly, at least in the width direction of the support surface to a raised position in which the outer contour of the second frame structure still does not extend horizontally outwardly beyond the outer contour of the lifted and displaced support surface, to thereby form, when the support surface has a long side adjacent a wall, a space between the wall and the bed which permits easy access and passage by an attendant.

2. A bed according to claim 1, wherein the second frame structure comprises a thin sheet of material carrying the pivot-arm mechanism (37), all the edge parts of said sheet lying inwardly of the edge parts (30,31,38,39)

of the support surface (2) in the downwardly swung position of the pivot-arm mechanism.

3. A bed according to claim 1, wherein said second frame structure comprises a frame (36) arranged to rest on a floor.

4. A bed according to claim 3, wherein the frame (36) is of rectangular configuration with one open side; and the pivot-arm mechanism (37) is fixedly mounted on one corner of said frame.

5. A bed according to any one of claims 1–4, wherein the pivot-arm mechanism is arranged to pivot on shafts which are positioned obliquely relative to side edges of said support surface and parallel with the horizontal plane of said support surface (2).

* * * * *